US005454127A

United States Patent [19]

Dvorak et al.

[11] Patent Number: 5,454,127

[45] Date of Patent: Oct. 3, 1995

[54] UNBALANCED BASCULE BRIDGE WITH CONCRETE SLAB ROADWAY

[75] Inventors: Ivan Dvorak, Lake Bluff, Ill.; Shankar Nair, Baltimore, Md.; Vinod C. Patel, Carol Stream, Ill.

[73] Assignee: Teng & Associates, Inc., Chicago, Ill.

[21] Appl. No.: 219,776

[22] Filed: Mar. 30, 1994

[51] Int. Cl.[6] ..... E01D 15/00

[52] U.S. Cl. ..... 14/19; 14/42

[58] Field of Search ..... 14/18–20, 42, 14/43, 53, 61, 68

[56] References Cited

U.S. PATENT DOCUMENTS

| | | | |
|---|---|---|---|
| 1,203,695 | 11/1916 | Brown | 14/42 X |
| 2,271,697 | 2/1942 | Leffler et al. | 14/42 |
| 2,887,191 | 5/1959 | Lovell . | |
| 3,276,059 | 10/1966 | Allen . | |
| 3,308,496 | 3/1967 | Mooney et al. . | |
| 3,376,795 | 4/1968 | Allen . | |
| 3,466,686 | 9/1969 | Allen . | |
| 4,473,916 | 10/1984 | Connold . | |

FOREIGN PATENT DOCUMENTS

| | | |
|---|---|---|
| 823943 | 9/1969 | Canada . |
| 2631641 | 11/1989 | France . |
| 0140443 | 2/1961 | U.S.S.R. . |
| 0614154 | 6/1978 | U.S.S.R. . |
| 0823484 | 5/1981 | U.S.S.R. . |

*Primary Examiner*—Michael Powell Buiz
*Attorney, Agent, or Firm*—Dvorak and Traub

[57] ABSTRACT

An unbalanced bascule bridge having an unbalanced bridge span including a pair of longitudinal girders with a low torsional stiffness interconnected at a pivoting end by a torsionally rigid cross-girder and interconnected along a longitudinal expanse of the longitudinal girders by a steel frame which forms a closely spaced lattice for supporting a relatively thin, lightweight concrete roadway deck. The bascule bridge span is raised and lowered by an actuator assembly including a plurality of hydraulic cylinders pivotally mounted on support columns and corresponding piston rods which apply a torque to the cross-girder through crank-plates welded to the cross-girder and pivotally interconnected to a base. The cross-girder isolates the longitudinal girders from all support and reaction forces while raising and lowering the bascule bridge span.

16 Claims, 5 Drawing Sheets

UNBALANCED BASCULE BRIDGE WITH CONCRETE SLAB ROADWAY

FIELD OF THE INVENTION

The present invention relates to an unbalanced BASCULE bridge and more particularly to a novel unbalanced bascule bridge span comprising longitudinal girders interconnected at a pivoting end by a cross-girder and interconnected along an expanse of the longitudinal girders by a steel frame for supporting a lightweight concrete roadway. The bascule bridge span is raised and lowered by a powerful bridge actuator that applies a torque to the cross girder which isolates the longitudinal girders of the bascule bridge span from support and reaction forces.

BACKGROUND OF THE INVENTION

A conventional bascule bridge interconnecting sections of a roadway or thoroughfare generally comprises a single-leaf bascule bridge span formed of torsionally rigid box-section girders, which are expensive to construct and maintain, and a massive counterweight disposed on a relatively short lever arm or rearward extension located behind a pivot point. The counterweight reduces torque and power requirements of a machine that raises and lowers the bascule bridge span about the pivot point. In double-leaf bascule bridges, counterweights on opposing bascule bridge spans also reduce forces on an anchoring devices that secure the opposing spans in a lowered position. A bascule bridge span having a counterweight requires a large volume of space or a pit below the roadway, and often below a water surface, to accommodate the counterweight as it swings downward through an arc of travel when the bridge is raised. The pit however represents a significant expense in the construction of a conventional bascule bridge. The size of the counterweight may be reduced by extending the length of the lever arm on which the counterweight is disposed but this requires an even larger pit to accommodate the increased arc traveled by the extended lever arm.

In the past, conventional bascule bridges have generally comprised a steel grating or steel plates disposed on the bascule bridge span as a roadway deck because it was thought that steel was lighter in weight than concrete and less susceptible to stress while raising and lowering the bascule bridge span. Steel grating however provides a rough roadway surface that is particularly noisy when traversed by motorized traffic and is dangerous to pedestrians who may easily loose their footing on the grated surface. Steel grating also allows drippings from vehicles to pass through the roadway deck onto water or land below which has an undesirable effect on the environment. It has been suggested to overcome these problems by filling the steel gratings with concrete. This proposed solution however eliminates the reduced weight benefit of the grating. Moreover, corrosion of the confined steel causes spalling and rapid deterioration of the concrete. Steel plate roadway decks have the disadvantage that they require installation of structural stiffeners which is labor-intensive and costly. Steel plate roadway decks also require an additional wearing surface to prevent corrosion and to improve traction. The wearing surface however must be bonded to the steel plate to ensure integrity during operation of the bridge and usually requires costly fabrication to ensure effective traction. There exists therefore a demonstrated need for an advancement in the art of bascule bridge design.

It is an object of the present invention to provide a novel bascule bridge.

It is also an object of the present invention to provide a novel bascule bridge having an unbalanced bridge span which eliminates the requirement for a large rearward structural extension to support a counterweight and a pit for receiving the counterweight.

It is another object of the present invention to provide a novel bascule bridge that is economical to build and operate.

It is a further object of the present invention to provide a novel unbalanced bascule bridge having longitudinal girders interconnected at a pivoting end by a cross-girder which isolates the longitudinal girders from support and operating forces.

It is yet another object of the present invention to provide a novel lightweight concrete roadway deck that is economical to construct, has a improved durability and service performance, and requires minimum maintenance.

Accordingly, the present invention is directed toward a novel unbalanced bascule bridge having an unbalanced bridge span including a pair of longitudinal girders with a low torsional stiffness interconnected at a pivoting end by a torsionally rigid cross-girder and interconnected along a longitudinal expanse of the longitudinal girders by a steel frame which forms a closely spaced lattice for supporting a relatively thin, lightweight concrete roadway deck. The bascule bridge span is raised and lowered by an actuator assembly including a plurality of hydraulic cylinders pivotally mounted on support columns and corresponding piston rods which apply a torque to the cross-girder through a corresponding pair of crank plates welded to the cross-girder and pivotally interconnected to a base by corresponding main trunnions. When the bascule bridge span is in a cantilevered or raised position, all support forces including the forces of the main trunnions and support members act on the cross-girder through the crank plates and all reaction forces including the forces of the longitudinal girders act directly on the cross-girder. Consequently, the cross-girder effectively isolates the longitudinal girders from the support and operating forces some of which may be non-uniform due to lack of symmetry in the forces applied by the plurality of piston rods, possible bearing or trunnion misalignment and unequal weight distribution by absorbing the non-uniform effects thereby ensuring proper support and alignment of the longitudinal girders.

These and other objects, features and advantages of the present invention will become apparent upon consideration of the following Detailed Description of the Invention with the accompanying drawings.

DETAILED DESCRIPTION OF THE INVENTION

Figure 1:
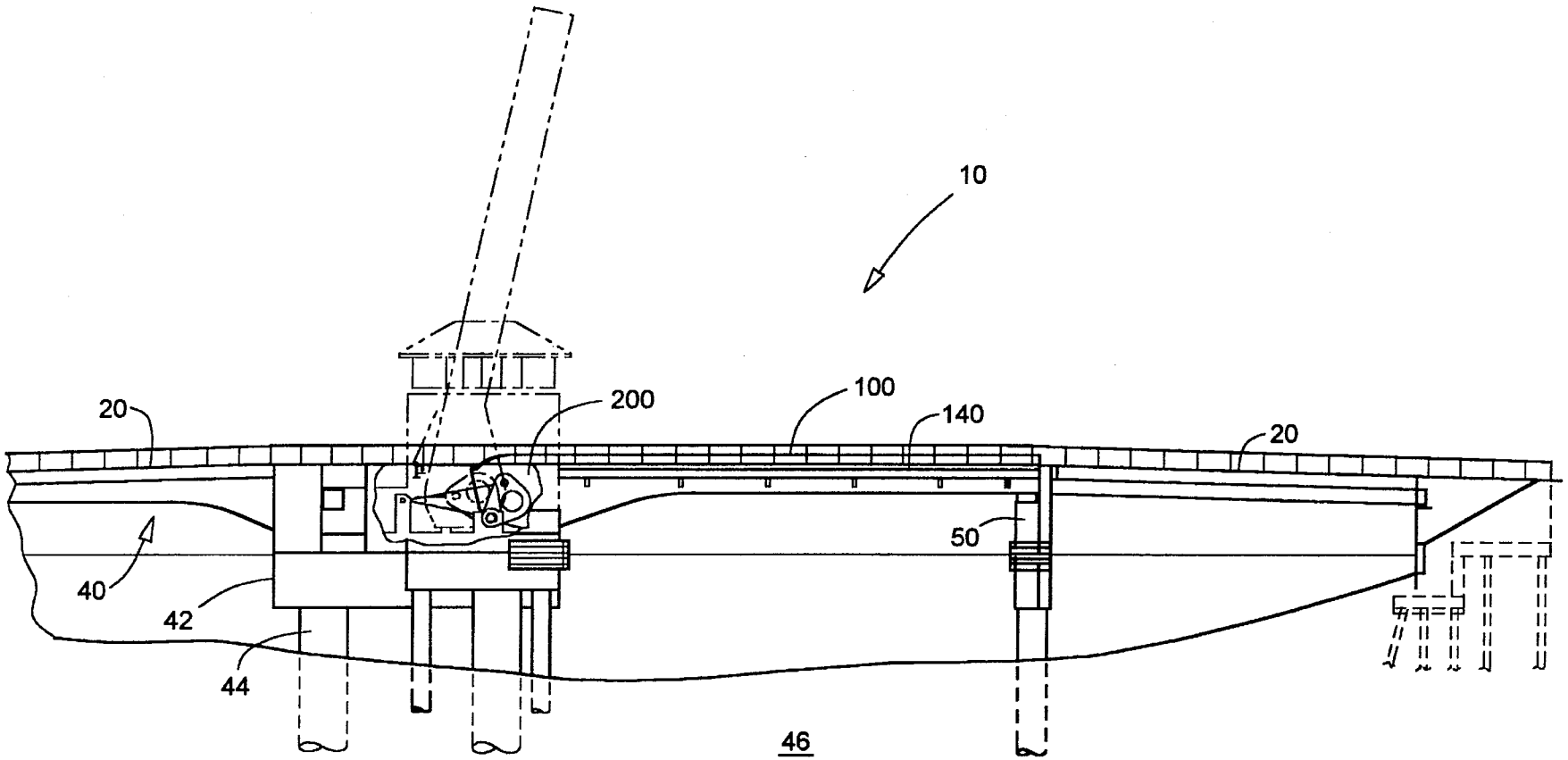
FIG. 1 is an elevation view of a bascule bridge of the present invention.

FIG. 1 is an elevation view of an unbalanced bascule bridge 10 of the present invention generally comprising a single-leaf unbalanced bascule span 100 interconnecting sections of a roadway or an approach span 20 which traverse a waterway. The unbalanced bascule span 100 is pivotable at a pivoting end by a bridge actuator assembly 200 which raises and lowers the unbalanced bascule span to permit, in the exemplary embodiment, passage of a vessel navigating the waterway. An opposing end of the bascule bridge 100 may be supported by a support member 50 when the bascule bridge span 100 is in a lowered roadway interconnecting position. The invention is equally applicable to an unbalanced bascule bridge comprising a double-leaf unbalanced bascule span which traverses a waterway or other obstacle.

Figure 2A:
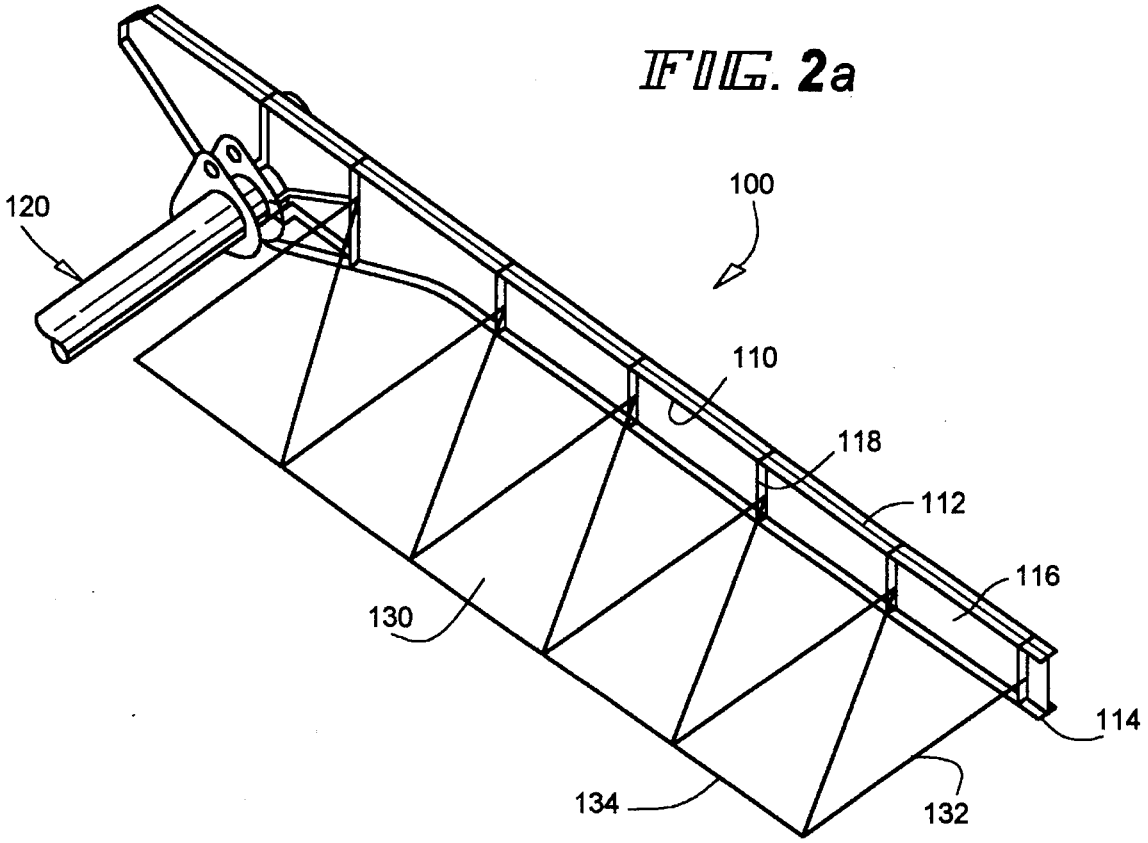
FIG. 2*a* is a partial perspective view of an unbalanced bascule bridge span.
Figure 2B:
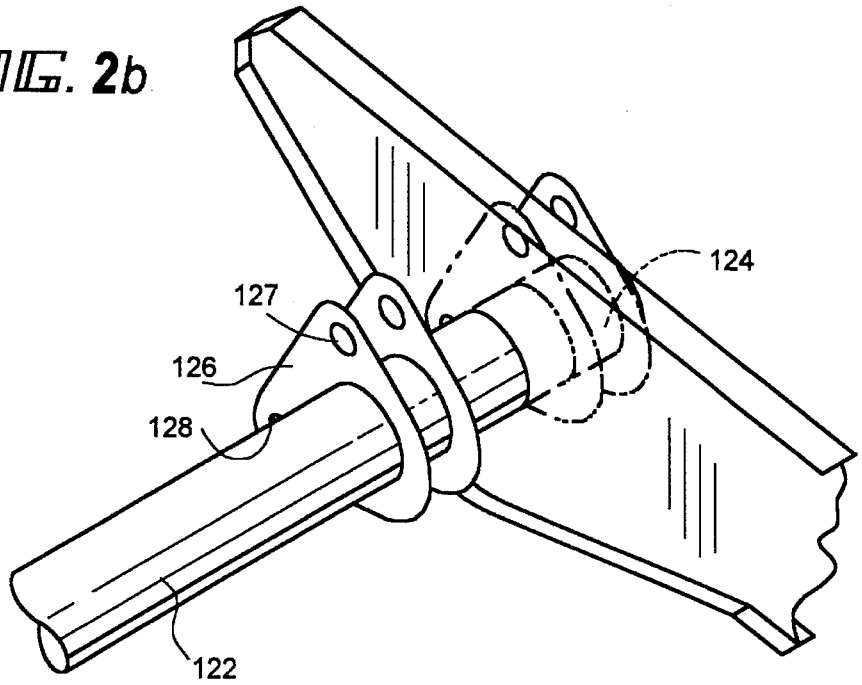
FIG. 2*b* is a partial perspective view of FIG. 2*a*.

FIGS. 2*a* and 2*b* are partial perspective views of the unbalanced bascule span 100 generally comprising two parallel longitudinal girders 110 interconnected, by a weld, at one end by a cross-girder 120 and interconnected along a longitudinal expanse of the girders 110 by a steel frame 130 which supports a roadway deck 140. The longitudinal girders 110 have a low torsional stiffness or strength and comprise welded steel plates forming a top flange 112 and a bottom flange 114 interconnected by a plurality of sections 116 and a plurality of transverse flanges 118 giving the longitudinal girders 110 an I-shaped cross-section. Longitudinal girders with alternative geometries having comparable structural characteristics may be used as an equivalent. The cross-girder 120 is torsionally and flexurally rigid steel of circular cross-section and comprises a central girder portion 122 and two end portions 124 extending beyond a separation width of the longitudinal girders 110. A plurality of D-shaped crank plates 126 each having an upper hole 127 and a lower hole 128 are arranged in pairs and welded to the central and end girder portions 122 and 124. The steel frame 130 comprises a plurality of transverse floor beams 132 rigidly connected to the longitudinal girders 110 and a plurality of longitudinal stringers 134 which extend along the longitudinal expanse of the longitudinal girders 110 and interconnect the transverse floor beams 132 to form a steel frame 130 having a closely spaced lattice structure. The low torsional stiffness of the longitudinal girders 110 make possible the rigid connection of the transverse floor beams 132 to the longitudinal girders 110 without risk of generating excessive stress in the floor beams, connections and longitudinal girder components.

The roadway deck 140 comprises a steel reinforced concrete slab that is fastened to the transverse floor beams 132 and the longitudinal stringers 134 of the steel frame 130 by stud shear connectors 142. The weight of the concrete deck 140 is minimized by using a lightweight concrete having a small slab thickness in combination with the closely spaced lattice structure steel frame 130 which forms a structurally composite unit. The concrete deck 140 is supported well below the top flange 112 of the longitudinal girders 110 by the steel frame 130 to reduce stress in the concrete deck 140 when the bascule bridge span 100 is raised and lowered. Tensile stress in the concrete deck 140 is further reduced by fastening the concrete deck 140 to the steel frame 130 when longitudinal girders 110 and steel frame 130 of the bascule bridge span 100 are in a cantilevered or raised position whereby the concrete deck 140 is in a "neutral" condition when the bascule bridge span 100 is raised and the concrete deck 140 is in a "prestressed" condition when the span 100 is lowered. The bascule bridge span 100 is interconnected to the roadway 20 by a trap door 160 which is pivotally interconnected to a portion of the roadway 20 by a hinge 162 at a first end and further comprises a roller assembly 164 at a second end which may include a bevelled surface 166 that provides a smooth interface with the roadway deck 140. Additional structure like a pedestrian walkway and handrail may also be supported by the longitudinal girders 110 and the steel frame 130. In the alternative, the roadway deck 140 may be configured for rail traffic by disposing rails over the steel frame 130 in addition to or in place of the concrete roadway deck 140.

Figure 3:
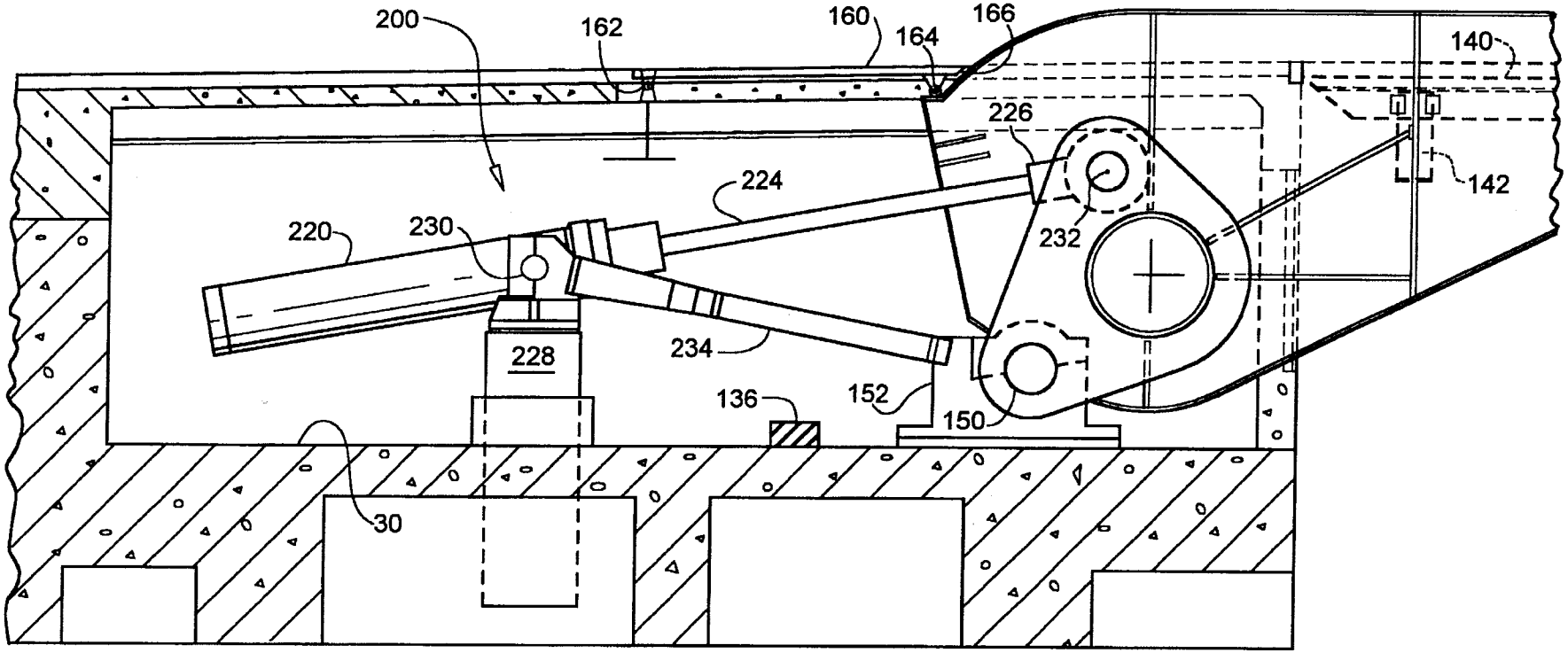
FIG. 3 is a partial sectional view of a bascule bridge in a closed position.
Figure 4:
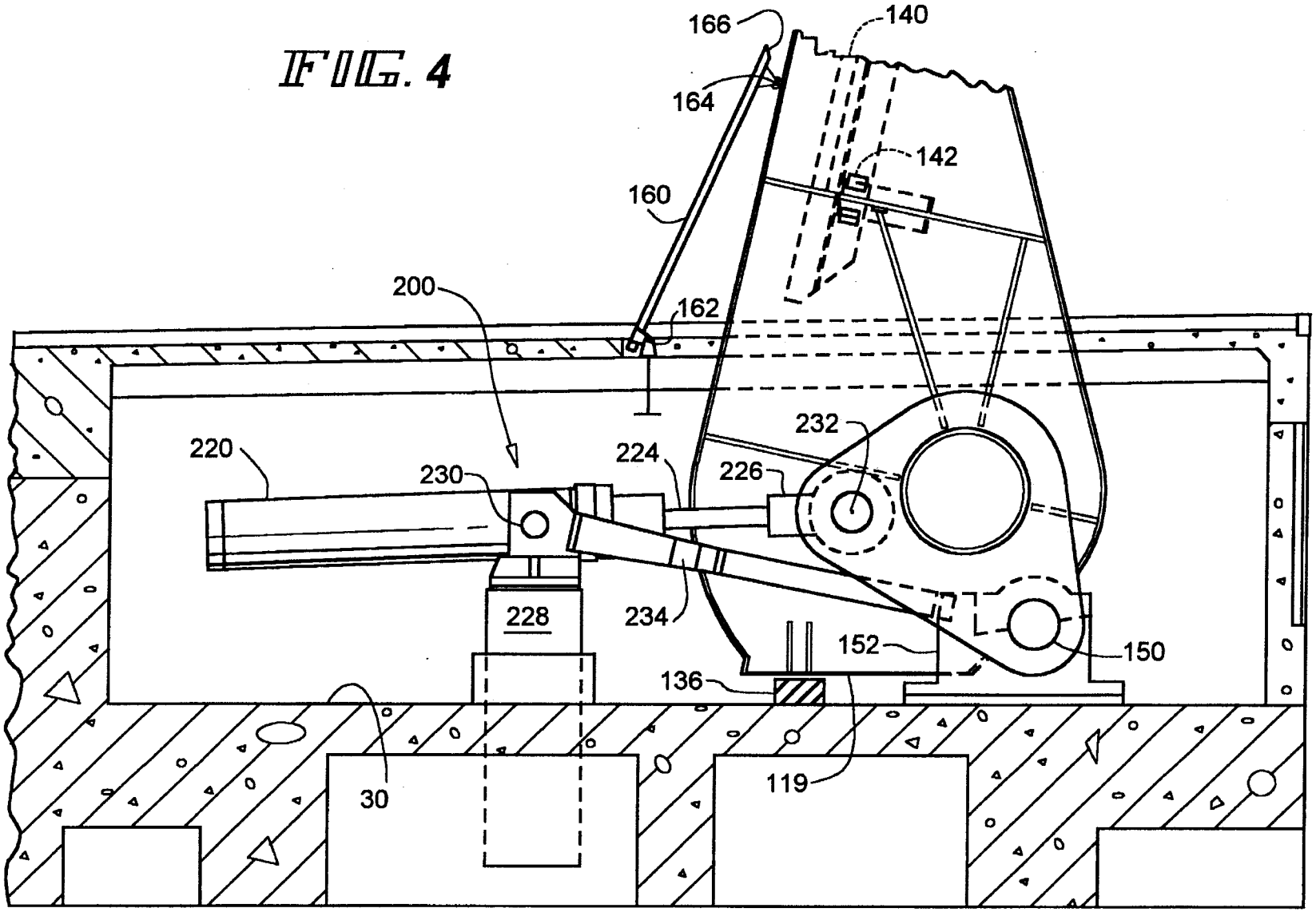
FIG. 4 is a partial sectional view of a bascule bridge in an open position.
Figure 5A:
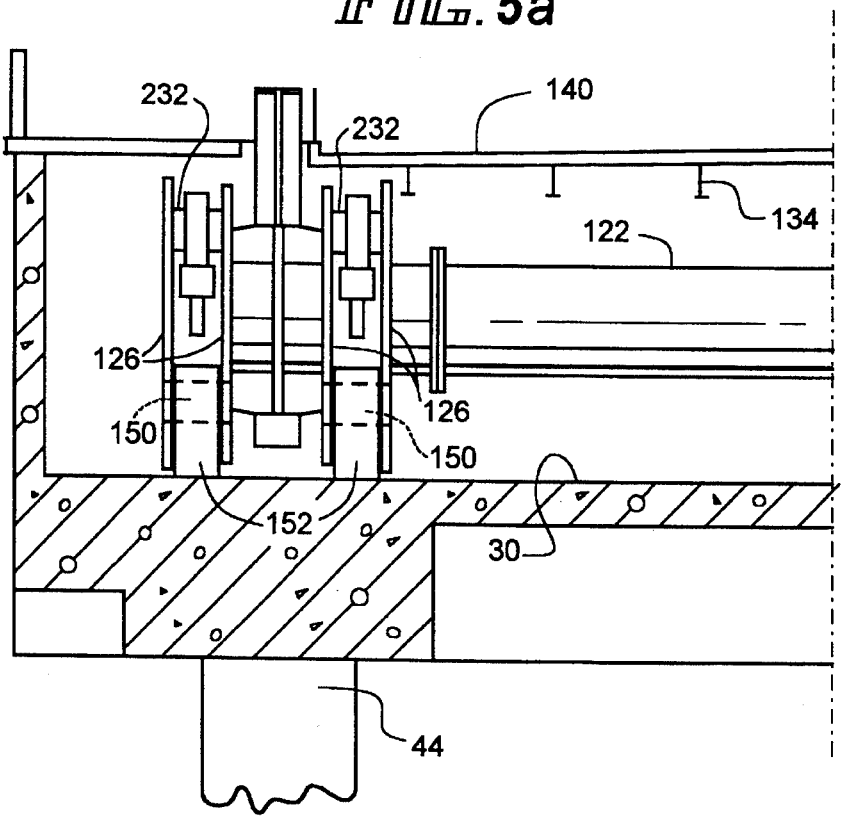
FIG. 5*a* is a partial cross-sectional view along lines IVa of FIG. 2.
Figure 5B:
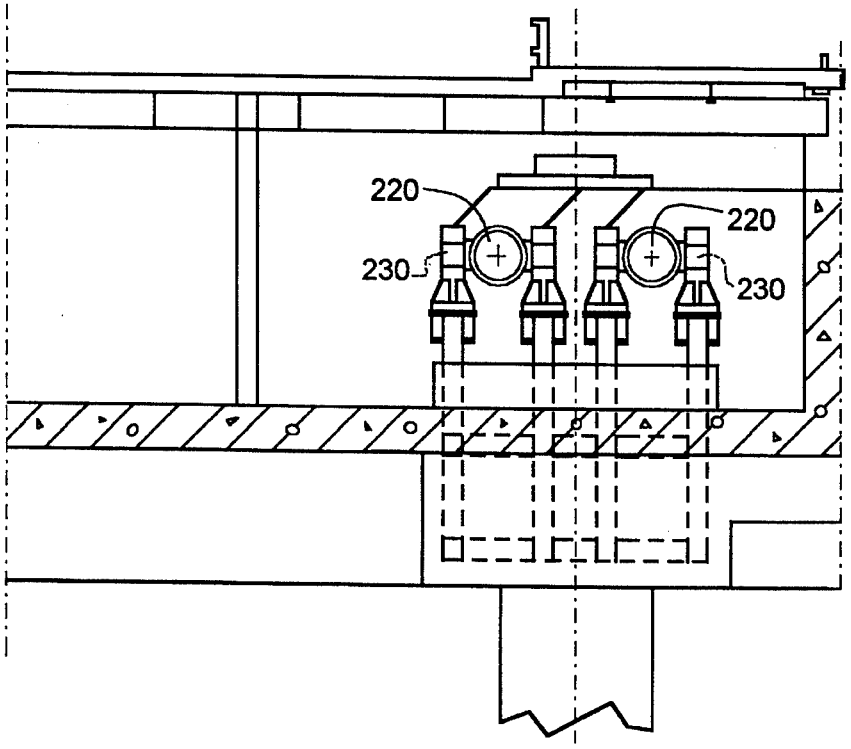
FIG. 5*b* is a partial cross-sectional view along lines IVb of FIG. 2.

FIGS. 3 and 4 are partial sectional views of the unbalanced bascule bridge 10 showing both the bascule bridge span 100 and the bascule bridge actuator assembly 200 mounted on a concrete base or foundation 30 which in the exemplary embodiment of FIG. 1 is a pier 40 comprising a base 42 supported by a plurality of caisson foundations 44 piled or supported in the river bed 46. FIGS. 5*a* and 5*b* are partial sectional views of FIG. 3 illustrating, in part, a plurality of trunnions 150 extending through the lower holes 128 of corresponding pairs of crank plates 126 of the bascule bridge span 100 to pivotally interconnect the pairs of crank plates 126 to a corresponding support member 152 permanently mounted on the base 30. A bumper block 136 may be disposed on the base 30 below end portion 119 of the longitudinal girders 110 to damp excessive rotation or pivoting action of the bridge span 100 although the bascule bridge span 100 is not designed to rest on the bumper blocks during operation as further discussed below. The actuator assembly 200 generally comprises a plurality of hydraulic cylinders 220 having a hydraulically actuated piston rod 224 with a piston rod eye 226 pivotally interconnected by corresponding rod trunnions 232 to the upper holes 127 of a corresponding pair of crank plates 126. A cylinder trunnion 230 pivotally interconnects each hydraulic cylinder 220 to a corresponding cylinder support column 228 permanently mounted on the base 30 and at least one static strut 234 extends from each support column 228 to each support member 152.

In operation, the unbalanced bascule bridge span 100 is raised from its lowered position in which the span 100 interconnects the sections of roadway 20 by actuating the plurality of bridge actuators 200 by retracting the piston rods 224 into the hydraulic cylinders 220 which pivots the crank plates 126 and the bascule bridge span 100 in a counter-clockwise direction about the main trunnions 150 and at the same time pivots the hydraulic cylinders 220 about the cylinder trunnions 230 as shown in FIGS. 1 and 4. As the bascule bridge is raised, the roller assembly 164 moves along the bascule bridge span 100 pivoting the trap door 160 in a counter-clockwise direction about the hinge 162 to remove a portion of the roadway comprising the trap door 160 that would otherwise obstruct the pathway of the pivoting bascule bridge span 100 as shown in FIG. 4. When the bascule bridge span 100 is in a cantilevered or raised position, all support forces including the forces of the main trunnions 150 and support members 152 act on the cross girder 120 through the crank plates 126 and all reaction forces including the forces of the longitudinal girders 110 act directly on the cross girder 120. Consequently, the cross-girder 120 effectively isolates the longitudinal girders 110 from the support and reaction forces some of which may be non-uniform due to lack of symmetry in the forces applied by the plurality of piston rods 224, possible bearing or trunnion misalignment and unequal weight distribution by absorbing the non-uniform effects thereby ensuring proper support and alignment of the longitudinal girders 110. The bascule bridge span 100 is lowered from its raised or cantilevered position by actuating the plurality of bridge actuators 200 to extend the piston rods 224 from the hydraulic cylinders 220 which pivots the crank plates 126 and the bascule bridge span 100 in a clockwise direction about the main trunnions 150 and at the same time pivots the hydraulic cylinders 220 about the cylinder trunnions 230 as shown in FIGS. 1 and 3. As the bascule bridge is lowered, the roller assembly 164 moves back along the bascule bridge span 100 pivoting the trap door 160 in the clockwise direction about the hinge 162 to position the trap door 160 between the roadway 20 and the bascule bridge span 100 which maintains a continuous interface between the roadway and the bascule bridge span 100 as shown in FIG. 1 and 3.

The foregoing description will enable one of ordinary skill in the art to make and use the preferred embodiments of the present invention and it will be understood that there exists variations, modifications and equivalents to the embodiments disclosed herein. The present invention therefore is to be limited only by the scope of the appended claims.

What is claimed is:

1. An unbalanced bascule bridge interconnecting a section of a thoroughfare, comprising:

an unbalanced bridge span having a pair of longitudinal girders interconnected at a pivoting end by a cross-girder and interconnected along an expanse of the longitudinal girders by a frame supporting a roadway deck;

a crank-plate fixedly disposed on the cross-girder and pivotally interconnected to a base by a main trunnion; and a bridge actuator assembly pivotally disposed on the base and connected to the crank-plate wherein the bridge actuator assembly may apply a torque to the cross-girder through the crank-plate to pivot the bascule bridge span about the main trunnion.

2. The unbalanced bascule bridge of claim 1 further comprising longitudinal girders formed of a low torsional stiffness steel and a cross-girder formed of a torsionally rigid steel wherein the cross-girder effectively isolates the longitudinal girders from support and reaction forces thereby ensuring proper support and alignment of the longitudinal girders.

3. The unbalanced bascule bridge of claim 2 further comprising a plurality of transverse floor beams rigidly connected to the longitudinal girders and a plurality of longitudinal stringers connected to the transverse floor beams to form a steel frame having a closely spaced lattice structure wherein low torsional stiffness of the longitudinal girders makes possible the rigid connection between the transverse floor beams and the longitudinal girder without a risk of generating excessive stress in the floor beams, connections and longitudinal girder while raising and lowering the bascule bridge span.

4. The unbalanced bascule bridge of claim 3 further comprising a roadway deck formed of a steel reinforced, lightweight concrete slab connected to the transverse floor beams and the longitudinal stringers of the steel frame to form a composite unit wherein the roadway deck is in a prestressed condition when the bascule bridge span is lowered and in a neutral condition when the bascule bridge span is raised.

5. The unbalanced bascule bridge of claim 1 wherein the bridge actuator assembly further comprises a hydraulic cylinder pivotally mounted to the base by a cylinder trunnion and a piston rod extendable from and retractable into the hydraulic cylinder, the piston rod including a rod eye pivotally connected to the crank-plate by a rod trunnion wherein the piston rod applies a torque to the cross-girder through the crank-plate to pivot the bascule bridge span about the main trunnion.

6. The unbalanced bascule bridge of claim 5 wherein the crank-plate is a D-shaped plate having an upper hole and a lower hole, wherein the main trunnion extends through the lower hole and pivotally interconnects the crank-plate and the base and wherein the rod trunnion extends through the upper hole and pivotally interconnects the crank-plate and the rod eye.

7. The unbalanced bascule bridge of claim 6 further comprising a support column mounted on the base, the hydraulic cylinder pivotally mounted to the support column by the cylinder trunnion.

8. The unbalanced bascule bridge of claim 6 further comprising:

a plurality of bridge actuator assemblies each having a corresponding hydraulic cylinder pivotally mounted to the base and a piston rod extendable from and retractable into the hydraulic cylinder, each piston rod including a piston eye;

a plurality of D-shaped crank-plates having an upper hole and a lower hole, the D-shaped crank-plates fixedly disposed on the cross-girder and pivotally interconnected to the base by a plurality of corresponding main trunnions extending through the lower hole, the crank-plates arranged in pairs wherein the piston rod eyes are interconnected to the a corresponding pair of crank-plates by a corresponding rod trunnion extending through the upper holes thereof.

9. The unbalanced bridge of claim 6 further comprising a trap door interconnecting the roadway deck at the pivoting end of the longitudinal girders and the thoroughfare, the trap door having a pivoting end pivotally interconnected to a portion of the thoroughfare by a hinge, wherein the trap door is pivoted when the bascule bridge span is raised to remove a portion of the roadway comprising the trap door that would otherwise obstruct a pathway of the pivoting bascule bridge span.

10. The unbalanced bascule bridge of claim 7 further comprising a static strut interconnecting the cylinder support and the main trunnion.

11. An unbalanced bascule bridge interconnecting a section of a thoroughfare, comprising:

an unbalanced bridge span having a pair of longitudinal girders formed of a low torsional stiffness steel interconnected at a pivoting end by a cross-girder formed of a torsionally rigid steel wherein the cross-girder effectively isolates the longitudinal girders from support and reaction forces thereby ensuring proper support and alignment of the longitudinal girders;

a plurality of transverse floor beams rigidly connected to the longitudinal girders and a plurality of longitudinal stringers connected to the transverse floor beams to form a steel frame having a closely spaced lattice structure wherein low torsional stiffness of the longitudinal girders makes possible the rigid connection between the transverse floor beams and the longitudinal girder without a risk of generating excessive stress in the floor beams, connections and longitudinal girder while raising and lowering the bascule bridge span;

a roadway deck formed of a steel reinforced, lightweight concrete slab connected to the transverse floor beams and the longitudinal stringers of the steel frame to form a composite unit wherein the roadway deck is in a prestressed condition when the bascule bridge span is lowered and in a neutral condition when the bascule bridge span is raised;

a D-shaped crank-plate having an upper hole and a lower hole, the D-shaped crank-plate fixedly disposed on the cross-girder and pivotally interconnected to a base by a main trunnion extending through the lower hole; and a bridge actuator assembly having a hydraulic cylinder pivotally mounted on the base by a cylinder trunnion and a piston rod extendable from and retractable into the hydraulic cylinder, the piston rod including a rod eye pivotally interconnected to the D-shaped crank-plate by a rod trunnion extending through the upper hole wherein the piston rod applies a torque to the cross-girder through the crank-plate to pivot the bascule bridge span about the main trunnion.

12. The unbalanced bascule bridge of claim 11 further comprising a support column mounted on the base, the hydraulic cylinder pivotally mounted to the support column by a cylinder trunnion.

13. The unbalanced bascule bridge of claim 11 further comprising:

a plurality of bridge actuator assemblies each having a corresponding hydraulic cylinder pivotally mounted to the base and a piston rod extendable from and retractable into the hydraulic cylinder, each piston rod including a piston eye; and a plurality of D-shaped crank-plates having an upper hole and a lower hole, the D-shaped crank-plates fixedly disposed on the cross-girder and arranged in pairs, the crank-plates pivotally interconnected to the base by a main trunnions extending through the lower holes of corresponding pairs of D-shaped crank-plates, and wherein the piston rod eyes are interconnected to the a corresponding pair of crank-plates by a corresponding rod trunnion extending through the upper holes thereof, whereby the cross-girder effectively isolates the longitudinal girders from support and reaction forces some of which may be non-uniform due to lack of symmetry in the force applied by the plurality of piston rods, trunnion misalignment, and unequal weight distribution thereby ensuring proper support and alignment of the longitudinal girders.

14. The unbalanced bridge of claim 11 further comprising a trap door interconnecting the roadway deck at the pivoting end of the longitudinal girders and the thoroughfare, the trap door having a pivoting end pivotally interconnected to a portion of the thoroughfare by a hinge, wherein the trap door is pivoted when the bascule bridge span is raised to remove a portion of the roadway comprising the trap door that would otherwise obstruct a pathway of the pivoting bascule bridge span.

15. The unbalanced bascule bridge of claim 11 further comprising a static strut interconnecting the support column and the main trunnion.

16. A method for operating an unbalanced bascule bridge interconnecting a section of a thoroughfare, the bascule bridge including an unbalanced bridge span having a pair of longitudinal girders formed of a low torsional stiffness steel interconnected at a pivoting end by a cross-girder formed of a torsionally rigid steel and interconnected along an expanse of the longitudinal girders by a frame supporting a roadway deck, a D-shaped crank-plate having an upper hole and a lower hole, the D-shaped crank-plate fixedly disposed on the cross-girder and pivotally interconnected to a base by a main trunnion extending through the lower hole, a bridge actuator assembly pivotally disposed on the base and having a hydraulic cylinder and a piston rod connected to the crank-plate by a rod trunnion extending through the upper hole, the method comprising steps of:

extending and retracting the piston rod from and into the hydraulic cylinder;

applying a torque to a the cross-girder through the D-shaped crank-plate with the extending and retracting piston rod;

pivoting the bascule bridge span about the main trunnion by applying the torque to the cross-girder; and isolating the longitudinal girders from support and reaction forces thereby ensuring proper support and alignment of the longitudinal girders.

* * * * *